US010342255B2

(12) United States Patent
Huston et al.

(10) Patent No.: US 10,342,255 B2
(45) Date of Patent: Jul. 9, 2019

(54) GRAVITY WATER PIPE

(71) Applicant: Stundenglass Incorporated, Austin, TX (US)

(72) Inventors: Tracey Huston, Austin, TX (US); Kevin Doyle, Austin, TX (US)

(73) Assignee: Trevor Huston, Austin, TX (US)

( * ) Notice: Subject to any disclaimer, the term of this patent is extended or adjusted under 35 U.S.C. 154(b) by 173 days.

(21) Appl. No.: 15/260,905

(22) Filed: Sep. 9, 2016

(65) Prior Publication Data

US 2018/0070630 A1 Mar. 15, 2018

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS 4,140,138 A * 2/1979 Keller ..... A24F 1/30
131/173

* cited by examiner

*Primary Examiner* — Eric Yaary
(74) *Attorney, Agent, or Firm* — Pierson IP, PLLC

(57) ABSTRACT

Embodiments of this disclosure include systems and methods configured to transfer water from a first chamber to a second chamber while a user ignites a combustible substance.

20 Claims, 15 Drawing Sheets

GRAVITY WATER PIPE

BACKGROUND INFORMATION

Field of the Disclosure

Examples of the present disclosure are related to systems and methods for a gravity water pipe. Specifically, embodiments are related to a gravity water pipe with a plurality of chambers that are configured to be rotated about an axis.

Background

Conventionally to operate a gravity water pipe, smoke is generated in an external chamber which is coupled to an inlet port that extends into a first chamber. Water may be placed within a second chamber, such that the water partially fills the second chamber. A combustible substance, such as tobacco, is placed in the external chamber and ignited. Smoke may then travel from the external chamber into the first chamber via the inlet port, where the first chamber is positioned to cover the second chamber. This generates a partial vacuum within the first chamber. During this process, attention must be given to not elevate a bottom surface of the first chamber above the water surface of the second chamber.

While a user is inhaling the smoke disposed within the first chamber of a conventional gravity water pipe via the inlet port, the first chamber is manually moved downward to increase the air pressure within the first chamber. By manually moving the first chamber downward, pressurized air within the first chamber is forced to exit the first chamber through the inlet port. However during this process, there is no mechanism to depressurize the air in the first chamber or dissipate the smoke within the first chamber, such that the smoke may be inhaled at a later point.

Accordingly, needs exist for more effective and efficient methods and systems for gravity water pipes.

SUMMARY

Embodiments of this disclosure may be directed towards a self-contained gravity water pipe, which for the sake of brevity may be referred to hereinafter as a "water pipe." While a user is utilizing the water pipe to inhale smoke, the water pipe may maintain all the water necessary for operation and preserve smoke that the user does not desire to inhale. The water pipe may use the force of gravity to allow water to be transferred between a first and second chamber positioned on different sides of a rotational axis, and air pressure may be utilized to transfer air or smoke to an outlet port.

In embodiments, the water pipe may include a first chamber, a second chamber, a coupling interface, a shaft, an inlet port, and an outlet port.

The first chamber and the second chamber may be substantially the same shape and/or size, and may be configured to be rotated about an axis of rotation defined by the shaft. In implementations, water may be configured to be disposed within the first chamber, wherein the water is encased within the water pipe to reduce, limit, and/or prevent water spillage.

The coupling interface may be configured to couple the first chamber and the second chamber together to form a unified, unitary system. In embodiments, the coupling interface may be configured to be rotated around the shaft. The coupling interface may also include a plurality of holes, wherein the plurality of holes extend through the coupling interface, such that liquid, air, and/or smoke may be selectively transferred between the first chamber and the second chamber.

The shaft may be a hollow tube configured to extend across the coupling interface. The coupling interface may include an inlet port positioned on a first end of the shaft, and an outlet port positioned on the second end of the shaft, wherein the inlet port and the outlet port extend in opposite directions. The inlet port may be configured to be coupled with a bowl, container, etc., which may be configured to hold a combustible substance, such as tobacco. Responsive to the combustible substance being ignited, the inlet port may be configured to transfer smoke into the an upper chamber. The outlet port may be configured to be coupled to a mouthpiece, and allow a user to receive smoke that may be positioned within the lower chamber.

The shaft may also include a plurality of holes that are configured to align with the plurality of holes positioned through the coupling interface. A first hole on the shaft may be configured to transfer smoke into the upper chamber. The first hole may transfer smoke to the upper chamber when the chambers are vertically aligned. A second hole may be configured to transfer air, smoke, and/or water between the first chamber and the second chamber. A third hole may be configured to transfer smoke from the lower chamber to the outlet port. The smoke may be transferred from either the first chamber or the second chamber based on the positioning of the chambers when the chambers are vertically aligned.

In embodiments, the water pipe may be configured to use the force of gravity to allow water to transfer from the first chamber to the second chamber when the chambers are vertically aligned and the first chamber is above the second chamber. While a user may ignite the combustible substance such that smoke may enter the first chamber, the user may simultaneously rotate the water pipe about the shaft. Then, the water pipe may be rotated again about the shaft, such that the first chamber is positioned above the second chamber. When the rotating of the water pipe is almost complete the inlet port may be activated to from a vacuum created in the first chamber. Water from the first chamber may then be dispensed into the second chamber via the shaft, causing a seal between the two chambers. This displacement of the water may create a void in the first chamber that will be filled with smoke while decreasing the volume of air positioned in the second chamber. Air positioned in the second chamber may be evacuated out of the second chamber via the outlet port due to the decreasing of volume of air within the second chamber. Once the water is finishing being dispensed into the second chamber, a user may either inhale the smoke in the first chamber through the shaft into the second chamber and out of the water pipe via the outlet port or the user may rotate the water pipe a second time. By rotating the water pipe the process may begin again, and water may dispense from the second chamber into the first chamber forcing the smoke out of the outlet port creating the gravity pipe affect for the user. Simultaneously if chosen, the user may re-ignite the combustible material filling the second chamber with smoke again ready for the next user.

In embodiments, the mouthpiece may be a hookah-style hose or aluminum mouthpiece and an outlet adapter, and the bowl may be a hookah-style bowl, drop in slide bowl or other variations of such for the inlet adapter. The adapters may be threaded to couple with the outlet and inlet ports, wherein the threads are similar to those used in conventional smoking pipes. Thus, users may substitute the bowl and mouthpiece with others. The adapters may also press onto the shaft using seals to create a bond.

Embodiments may also include a stand. The stand may include a holder configured to secure the shaft in place such that the shaft may be prevented from rotating while the water pipe is being rotated. However, the water pipe does not necessarily require a stand. For example, the first chamber and the second chamber may be mason jars or comparable bottles allowing the unit to rest on the bottles upright. The turning of the water pipe may then be a manual action.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
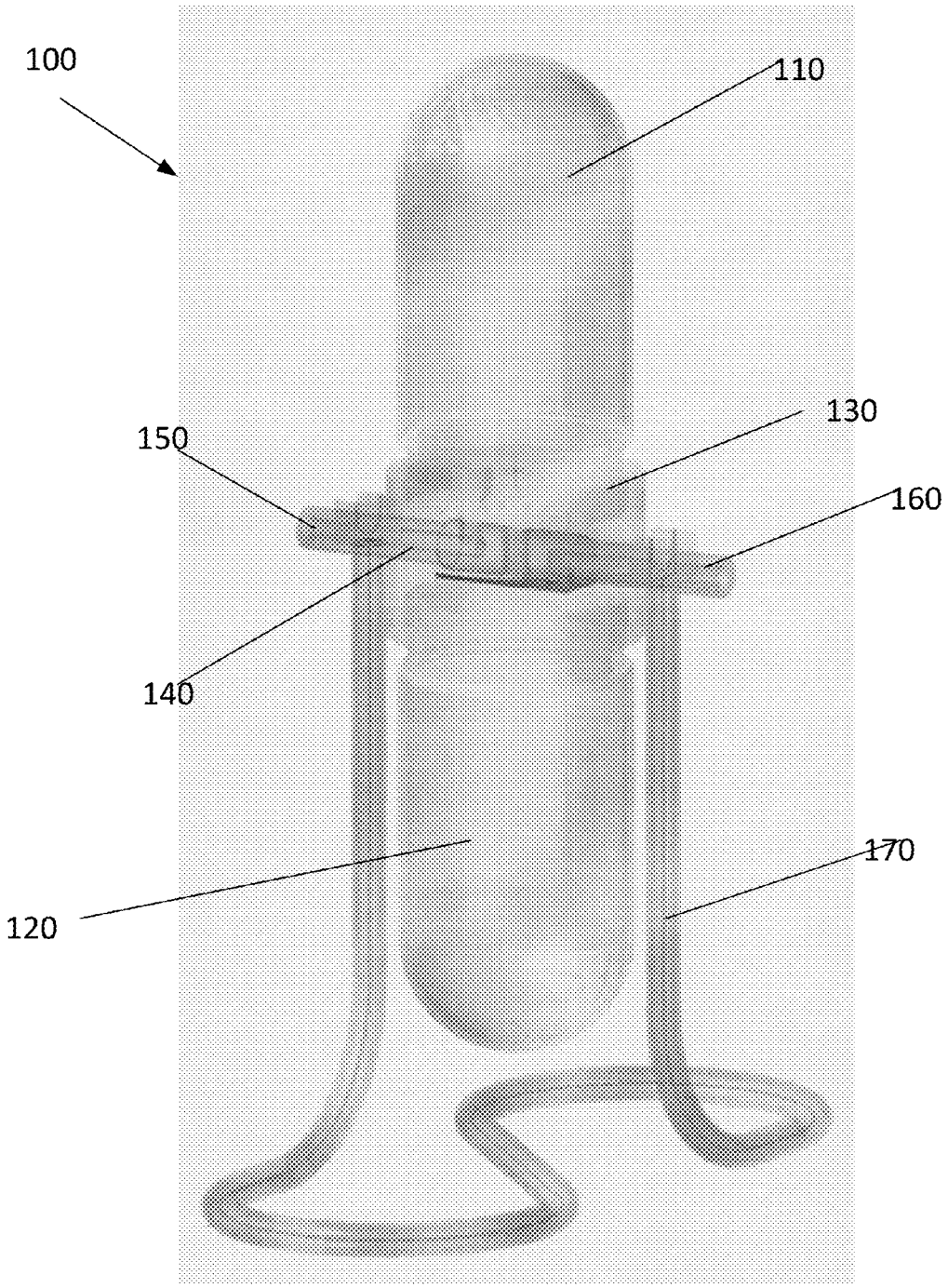
FIG. 1 depicts a perspective view of a water pipe, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent to one having ordinary skill in the art, that the specific detail need not be employed to practice the present embodiments. In other instances, well-known materials or methods have not been described in detail in order to avoid obscuring the present embodiments.

FIG. 1 depicts a perspective view of a water pipe 100, according to an embodiment. Water pipe 100 may include a first chamber 110, a second chamber 120, a coupling interface 130, a shaft 140, and stand 170.

First chamber 110 and second chamber 120 may be containers, bottles, vessels, etc. that are configured to hold and store liquids, air, and/or smoke. In embodiments, first chamber 110 and second chamber 120 may be manufactured in a plurality of different shapes, sizes, and/or materials. For example, in one embodiment, first chamber 110 and second chamber 120 may be comprised of glass, plastics, etc. First chamber 110 and second chamber 120 may each include a first side that includes a coupling member. The coupling member may be a screw closure that is configured to couple with a corresponding interface positioned on coupling interface 130. More specifically, the screw closure may include continuous threads or lugs that are configured to form an effective seal and barrier to limit, prevent, or reduce that water, air, and/or smoke from exiting from first chamber 110 and/or second chamber 120.

Coupling interface 130 may be a hardware device that is configured to couple first chamber 110, second chamber 120, and shaft 140 together. By coupling first chamber 110, second chamber 120, and shaft 140, water pipe 100 may be a unified, unitary device. Coupling interface 130 may include two coupling members positioned at each end of coupling interface 130. The coupling members may be screw closures that are configured to couple with the coupling members positioned on first chamber 110 and second chamber 120. However, one skilled in the art will appreciate that coupling interface 130 may be coupled to first chamber 110 and second chamber 120 via any known means, such as a lips, interlocks, etc.

Coupling interface 130 may also include an orifice extending from a first side to a second side of coupling interface 130. Furthermore, coupling interface 130 may include a plurality of holes (not shown) configured to extend from a top surface of coupling interface 130 to a bottom surface of coupling interface 130. The first hole disposed within coupling interface 130 may be configured to be coupled with an inlet port 150 of shaft 140, the second hole may be configured to allow smoke, air, and/or water to be transferred between first chamber 110 and second chamber 120, and a third hole may be configured to be coupled with an outlet port 160 of shaft 140.

Shaft 140 may be a hardware device with a hollow inner body extending from inlet port 150 to outlet port 160. Inlet port 150 may be positioned on a first side end of shaft 140, and outlet port 160 may be positioned on a second side of shaft 140, wherein inlet port 150 and outlet port 160 extend in opposite directions. Inlet port 150 may include an external chamber that is configured to receive a combustible substance, such as tobacco. Outlet port 160 may be configured to allow smoke disposed within first chamber 110 and/or second chamber 120 to exit the corresponding chamber. In embodiments, shaft 140 may be configured to be fixedly, positioned within coupling interface 130. Water pipe 100 may be configured to rotate around shaft 140 while shaft 140 is maintained in the same position.

Furthermore, shaft 140 may include a plurality of holes corresponding to the holes disposed within coupling interface 130. In embodiments, if first chamber 110 and second chamber 120 are vertically aligned, then the plurality of holes positioned within shaft 140 may be aligned with the plurality of holes within coupling interface 130. Responsive to the plurality of holes being aligned, water pipe 100 may be in the open position and smoke disposed within first chamber 110 or second chamber 120 may exit water pipe 100 via outlet port 160. If the plurality of holes are not aligned water pipe may be in the closed position. If water pipe 100 is in the closed position, then smoke disposed within first chamber 110 or second chamber 120 may not exit out of water pipe 100.

A first hole within shaft 140 may be positioned in the closest proximity to inlet port 150, and may be configured to allow smoke to enter into first chamber 110 or second chamber 120. The first hole may not extend through the diameter of shaft 140, and may be coupled to inlet port 150. Responsive to the combustible substance being ignited, smoke may enter either first chamber 110 or second chamber 120 via the first hole within shaft 140. In embodiments, the smoke may enter either first chamber 110 or second chamber 120 based on which chamber is positioned above the other chamber.

A second hole within shaft 140 may be positioned in the center of shaft 140 and extend through the diameter of shaft 140. Responsive to water pipe 100 being rotated to be in the open position, water positioned in an upper chamber may flow through the second hole to the lower chamber. Responsive to water pipe 100 being in the closed position, water positioned in the upper chamber may not flow through the second hole to the lower chamber.

The third hole within shaft 140 may be positioned in closest proximity to outlet port 160, and may be configured to allow smoke to exit first chamber 110 or second chamber 120. The third hole may not extend through the diameter of shaft 140 and may be coupled to outlet port 160. Responsive to the water pipe 100 being rotated to be in the open position, air pressure within water pipe 100 that is caused by the decrease in volume in the lower chamber may cause smoke disposed within the lower chamber of water pipe 100 to exit outlet port 160. In embodiments, the smoke may exit either first chamber 110 or second chamber 120 based on which chamber is positioned below the other chamber.

Stand 170 may be a device configured to hold shaft 140 in place while water pipe 100 is being rotated. Stand 170 may be comprised of various shapes, size, and materials. In embodiments, stand 170 may include a plurality of interfaces, where a first interface is configured to hold inlet port 150 in place and a second interface is configured to hold outlet port 160 in place. The first and second interfaces may be positioned at height such that first chamber 110 and second chamber 120 may rotate around shaft 140 without touching a floor surface.

Figure 2:
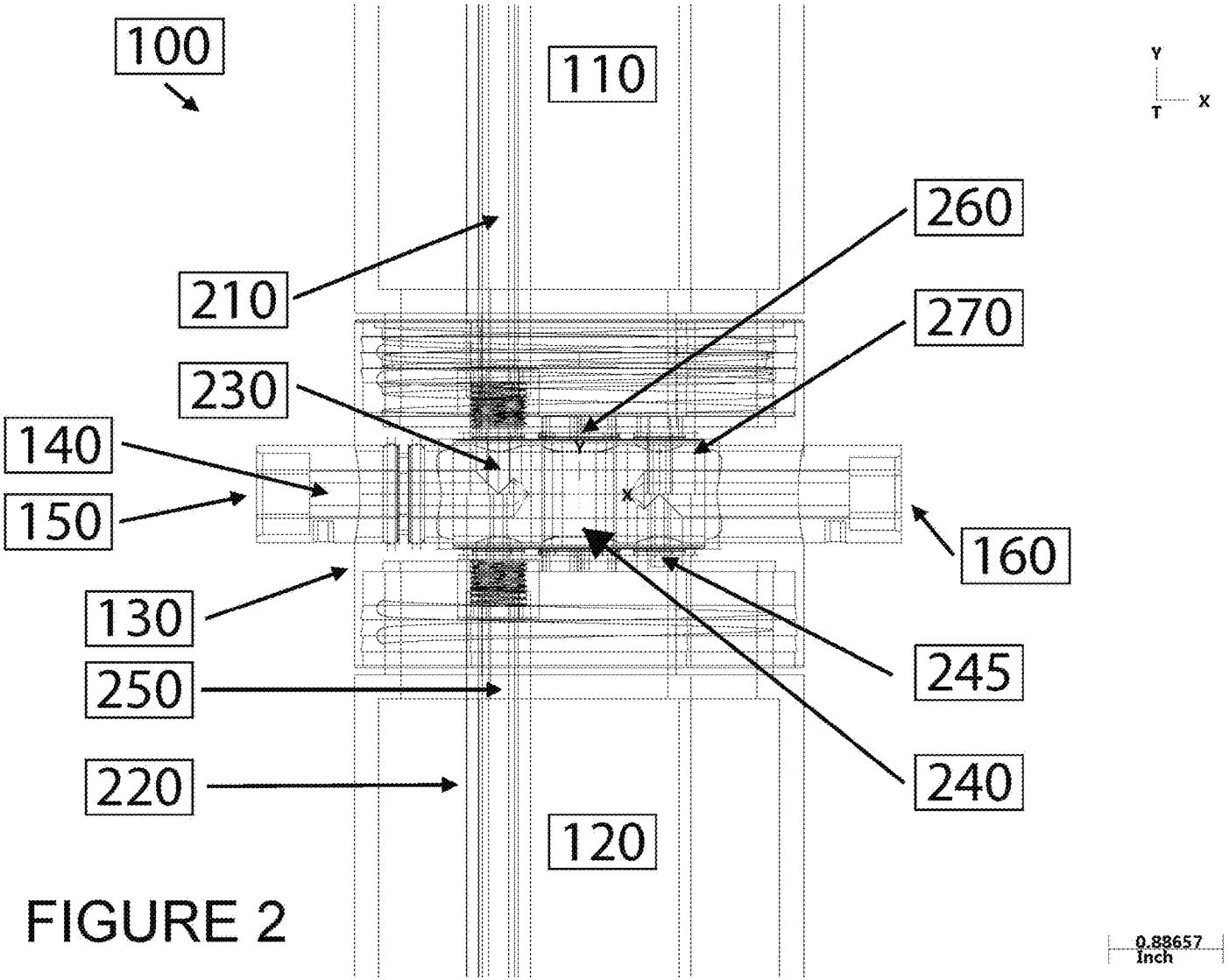
FIG. 2 depicts a detailed view of a front view of a water pipe, according to an embodiment.

FIG. 2 depicts a detailed view of a front view of water pipe 100, according to an embodiment. Certain elements in FIG. 2 may be substantially the same as elements depicted in FIG. 1, and for the sake of brevity a further description of these elements is not included.

FIG. 2 depicts water pipe 100 comprising a first tube 210, a second tube 220, coupling interface 130 which includes a first hole 250, a second hole, 260, and a third hole 270, and shaft 140 which includes a fourth hole 230, a fifth hole 240, and a sixth hole 245.

First tube 210 may be a tube extending from first hole 250 into first chamber 110, wherein first hole 250 may extend from a first side of coupling interface 130 to a second side of coupling interface 130. First tube 210 may be configured to be coupled with inlet port 150 and allow smoke to enter first chamber 110. In embodiments, first tube 210 may allow smoke to enter first chamber 110 via inlet port 150 if water pipe 100 is in the open position. First tube 210 may have a length that is set above a waterline if water is positioned within first chamber 110 and first chamber 110 is positioned above second chamber 120. First tube 210 may include an O-ring seal or pressure seal positioned between first tube 210 and first hole 230, wherein the seal may limit, reduce, or prevent liquids from exiting water pipe 100.

Second tube 220 may be a tube extending from first hole 250 into second chamber 120. Second tube 220 may be configured to be coupled with inlet port 150 and allow smoke to enter into second chamber 120. In embodiments, second tube 220 may allow smoke to enter second chamber 120 via inlet port 150 if water pipe 100 is in the open position. Second tube 220 may have a length that is set above a waterline if water is positioned within second chamber 120 and second chamber 120 is above first chamber 110. Second tube 220 may include an O-ring seal or pressure seal positioned between second tube 220 and first hole 250, wherein the seal may limit, reduce, or prevent liquids from exiting water pipe 100. In embodiments, if water pipe 100 is in the closed position, then the smoke may not enter either first chamber 110 or second chamber 120.

Fourth hole 230 through shaft 140 may be configured to allow smoke to enter into first chamber 110 or second chamber 120. As depicted in FIG. 2, fourth hole 230 may not extend through the entire diameter of shaft 140. Fourth hole 230 may have a first portion that extends horizontally into inlet port 150, and fourth hole 230 may have a second portion that extends vertically towards first chamber 110 or second chamber 120. If water pipe 100 is in the open position, the second portion may allow smoke from inlet port 150 to traverse fourth hole 230 and enter first chamber 110 or second chamber 120. The smoke may enter either first chamber 110 or second chamber 120 based on whichever chamber is positioned above the other chamber. Because shaft 140 is fixed and does not rotate, fourth hole 230 may not interface with whichever chamber is positioned below the other. If water pipe 100 is in the closed position, then smoke may enter fourth hole 230, yet first hole 250 and fourth hole 230 may not be aligned. Therefore, smoke may not exit fourth hole 230 into first chamber 110 or second chamber 120.

Fifth hole 240 positioned through shaft 140 may be configured to extend from a first side of shaft 140 to a second side of shaft 140. In embodiments, if water pipe 100 is in the open position, then fifth hole 240 positioned through shaft 140 and second hole 260 positioned through coupling interface 130 may be aligned. If the second hole 260 and fifth hole 240 are aligned, then water, air, and/or smoke may be transferred between first chamber 110 and second chamber 120. If water pipe 100 is in the closed position, then water, air, and/or smoke may not be transferred between first chamber 110 and second chamber 120 via fifth hole 240.

Sixth hole 245 within shaft 140 may be configured to allow smoke to be transferred from first chamber 110 or second chamber 120 to outlet port 160. Sixth hole 245 may not extend through the diameter of shaft 140 and may be coupled to outlet port 160. Sixth hole 245 may have a first portion that extend horizontally into outlet port 160, and sixth hole 245 may have a second portion that extends vertically towards first chamber 110 or second chamber 120. If water pipe 100 is in the open position, the second portion of sixth hole 245 may allow smoke from first chamber 110 or second chamber 120 to be transferred to outlet port 160.

The smoke from first chamber 110 or second chamber 120 may enter sixth hole 245 based on whichever chamber is below the other chamber. Because shaft 140 is fixed and does not rotate, sixth hole 245 may not interface with hole 270. If water pipe 100 is in the closed position, then smoke may enter sixth hole 245 because sixth hole 245 and third hole 270 may not be aligned.

Figure 3:
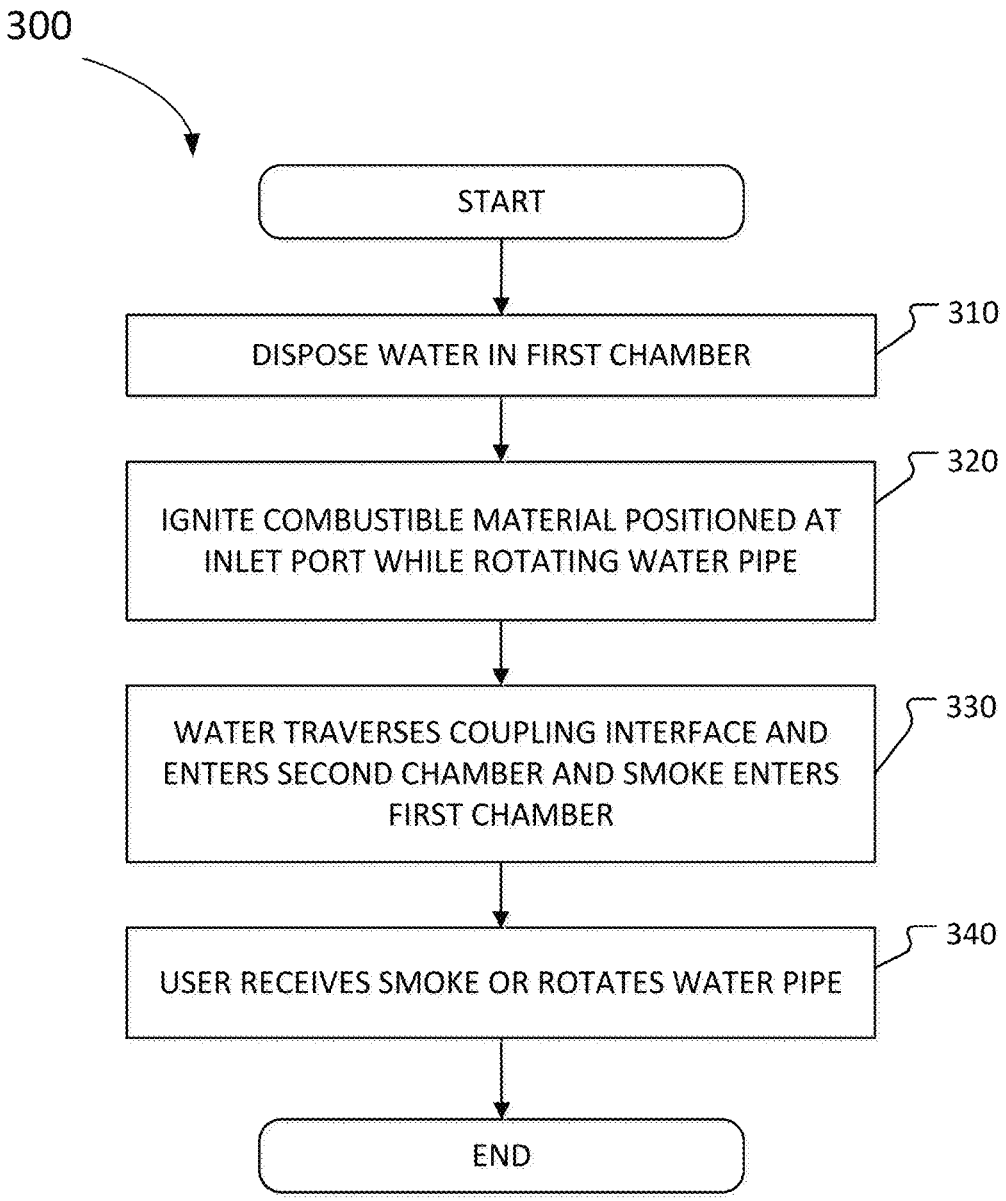
FIG. 3 illustrates a method for utilizing a water pipe to smoke a combustible material.

FIG. 3 illustrates a method 300 for utilizing a water pipe to smoke a combustible material. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting.

At operation 310, water may be disposed in a first chamber, wherein the first chamber may be positioned below a second chamber.

At operation 320, while the user is igniting the combustible material, the water pipe may then be rotated about a shaft, such that the first chamber is positioned above the second chamber. When the rotating of the water pipe is almost complete an inlet port may be activated, forming a vacuum in the first chamber.

At operation 330, water from the first chamber may then traverse the shaft and be dispensed into the second chamber via the water hole in the shaft. This displacement of water from the first chamber to the second chamber creates a void in the first chamber, which may be pull smoke within the inlet port to be positioned within the first chamber. The smoke may then be stored within the first chamber. While the water is being displaced from the first chamber to the second chamber, the water may form a seal between the two chambers. Additionally, the displacement of the water from the first chamber to the second chamber may decrease the volume of air positioned within the second chamber, causing air or smoke positioned in the second chamber to evacuate out of the second chamber via the outlet.

At operation 340, once the water is finishing being dispensed into the second chamber, a user may either inhale the smoke in the first chamber via the outlet port or the user may rotate the water pipe. In embodiments, the user may inhale the smoke that is positioned in the upper chamber, which may travel into the lower chamber via the shaft.

By rotating the water pipe the process may begin again, and water may dispense from the second chamber into the first chamber decreasing the volume of air position within the lower chamber forcing the smoke out of the outlet port. Simultaneously if chosen, the user may re-ignite the combustible material filling the upper chamber with smoke again.

Figure 4:
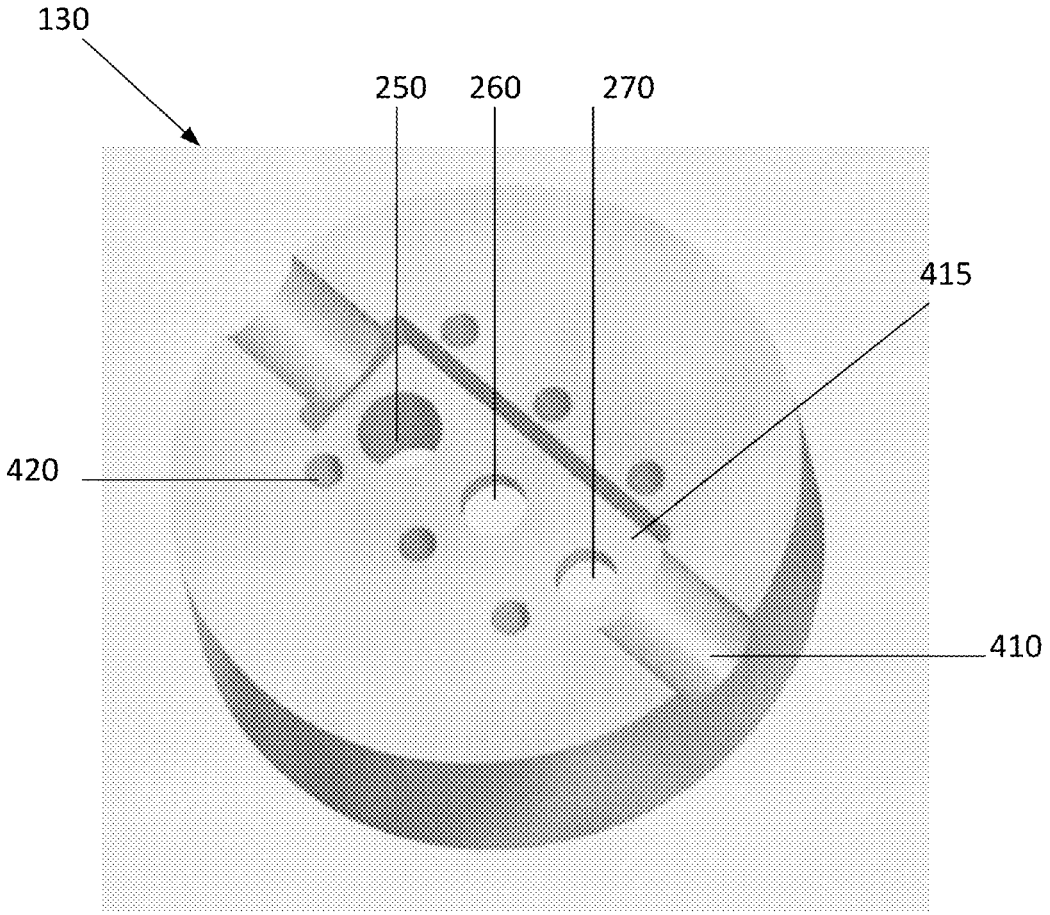
FIG. 4 depicts a horizontal cross section of a coupling interface, according to an embodiment.

FIG. 4 depicts a horizontal cross section of coupling interface 130, according to an embodiment. As depicted in FIG. 4, first, second, and third holes 250, 260, and 270 may extend through a body of coupling interface 130. Coupling interface 130 may also include depression 410, which may be configured to receive a shaft and allow coupling interface 130 to be rotated around the shaft, while fixing the shaft in place.

In embodiments, coupling interface 130 may be comprised of two symmetrical parts, which may be coupled together. For example, a first part of coupling interface 130 may be coupled with a second part of coupling interface 130 by screws traversing holes 420 to couple the two parts together.

Coupling interface 130 may also include a depression 415 configured to receive a seal. The seal may be configured to limit, reduce, or prevent leakage of water and/or smoke from coupling interface 130. Further, the seal may be shaped with a cylindrical inner surface configured to receive the shaft to secure the shaft in place while allowing for the rotation of coupling interface 130.

Figure 5:
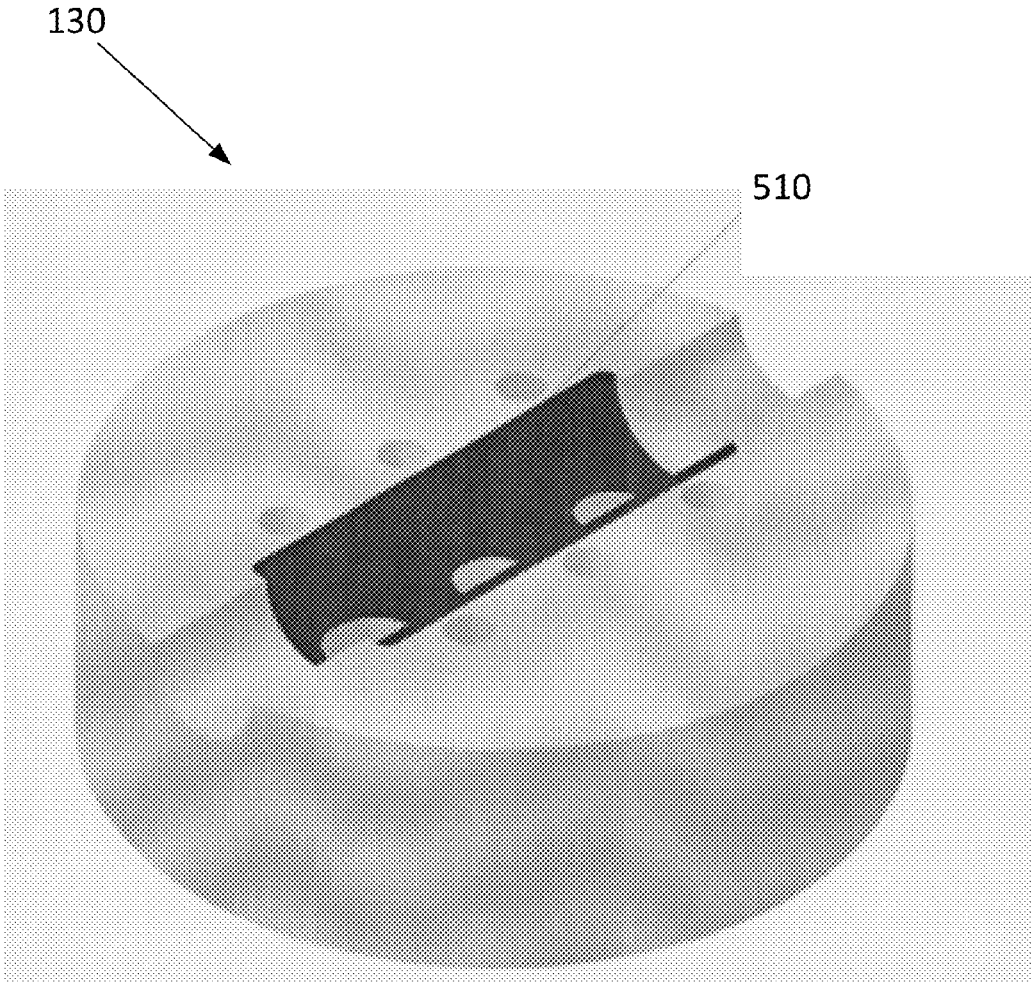
FIG. 5 depicts a horizontal cross second of coupling interface, according to an embodiment.

FIG. 5 depicts a horizontal cross second of coupling interface 130, according to an embodiment. Coupling interface 130 may include a Teflon seal 510. Teflon seal 510 may be shaped and/or sized to be placed within depression 415. Teflon seal 510 may be configured to provide a sealing surface within coupling interface 130. One skilled in the art will appreciate that Teflon seal 510 may be comprised of any material configured to seal surfaces.

Figure 6:
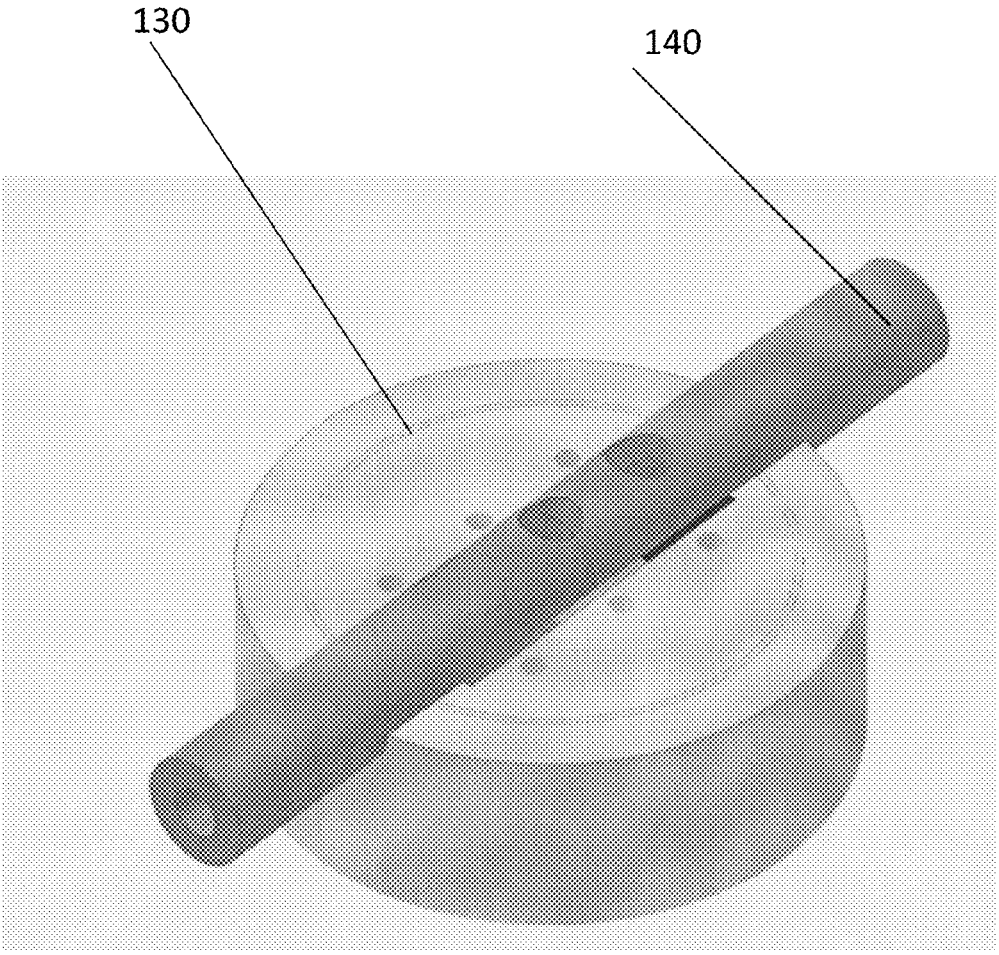
FIG. 6 depicts a shaft positioned on a first portion of a coupling interface, according to an embodiment.

FIG. 6 depicts shaft 140 positioned on a first portion of coupling interface 130, according to an embodiment. First and second sides of shaft 140 are configured to extend away from first and second sides of coupling interface 130, respectively. As such, coupling interface 130 may be rotated around shaft 140 while shaft 140 remains in place. As depicted in FIG. 6, at any point while the water pipe is in the open position, only the inlet or the outlet of the shaft may face an upward.

Figure 7:
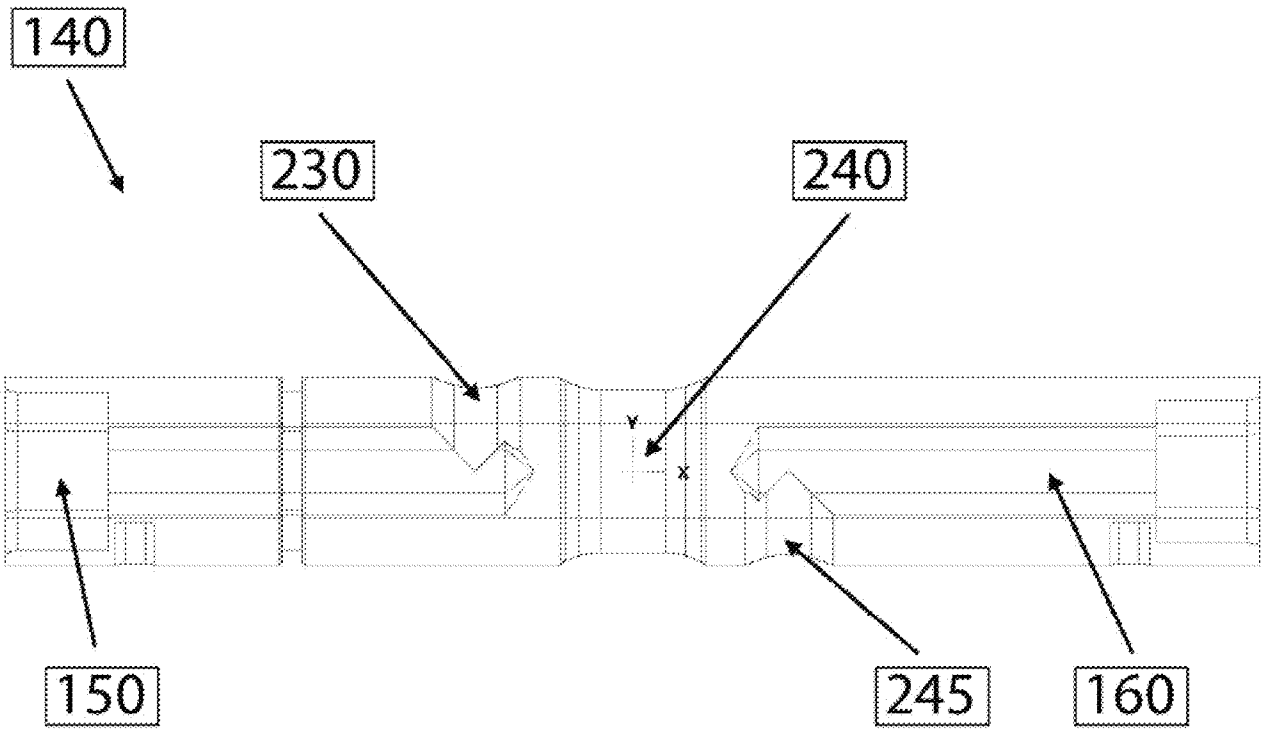
FIG. 7 depicts a cross section of a shaft, according to an embodiment.

FIG. 7 depicts a cross section of shaft 140, according to an embodiment.

As depicted in FIG. 7, smoke may enter shaft 140 via inlet port 150, and smoke may enter a first chamber via fourth hole 230, which are in communication with each other. Water and smoke may be able to be transferred between a first chamber to a second chamber via second hole 240 that extends through shaft 140. Smoke may be able to exit the second chamber to a mouthpiece coupled to outlet port 160 via sixth hole 245, which are in communication with each other. In embodiments, when a user inhales smoke, the smoke may be originally positioned in the upper chamber, traverse second hole 240 to be positioned in the lower chamber, which is then inhaled by the user.

Figure 8:
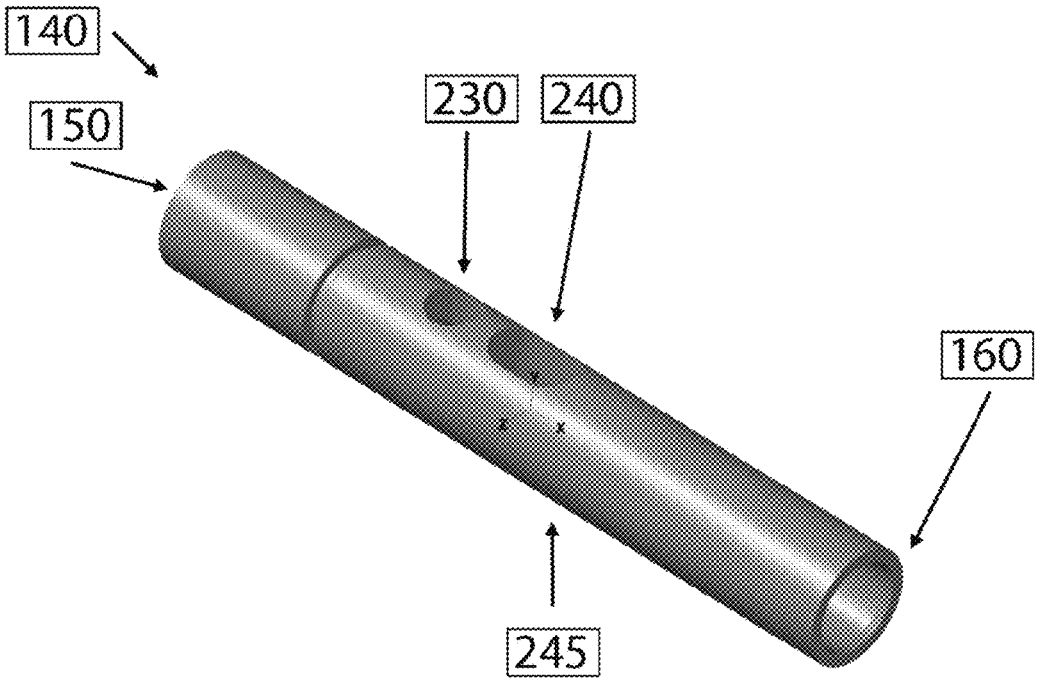
FIG. 8 depicts a perspective view of a shaft, according to an embodiment.

FIG. 8 depicts a perspective view of shaft 140, according to an embodiment. As depicted in FIG. 8, fourth hole 230 and sixth hole 245 are positioned on different sides of shaft 140, such that only either fourth hole 230 or sixth hole 245 may be positioned upward or downward at any given time. Furthermore, fifth hole 240 extends through the shaft 140.

Figure 9:
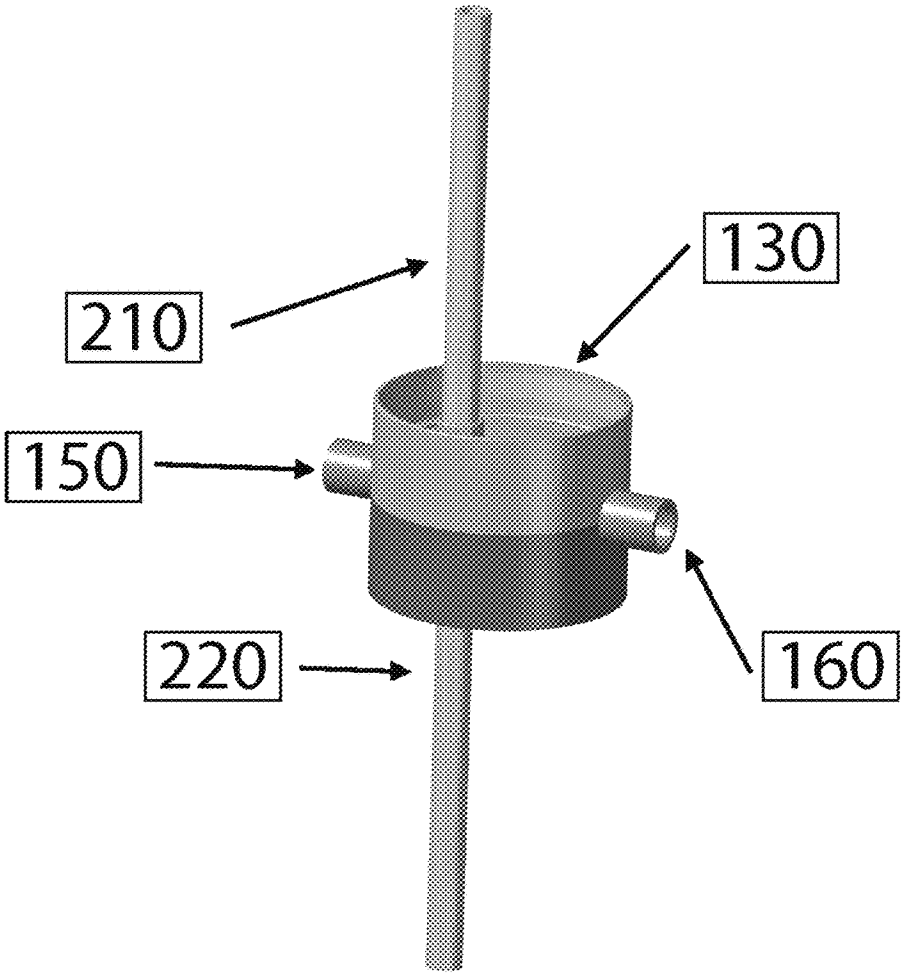
FIG. 9 depicts a perspective view of a coupling interface, according to an embodiment.

FIG. 9 depicts a perspective view of coupling interface 130, according to an embodiment. As depicted in FIG. 9, first tube 210 and second tube 220 project away from coupling interface 130. In implementations, as smoke is received from inlet port 150, the smoke may enter a first chamber via first tube 210. First tube 210 may have a height such that if all the water within the water pipe is within the first chamber and the first chamber is the top chamber, the height of first tube 210 may be above the water level. Additionally, second tube 220 may have a height such that if all the water within the water pipe is within the second chamber and the second chamber is the top chamber, the height of second tube 220 may be above the water level. Thus, as smoke is entering the first or second chamber via first tube 210 or second tube 220, respectively, water will not be able to exit the water pipe via first tube 210 or second tube 220.

Figure 10A:
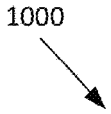
FIGS. 10A and 10B depict a shaft, according to an embodiment.
Figure 10B:
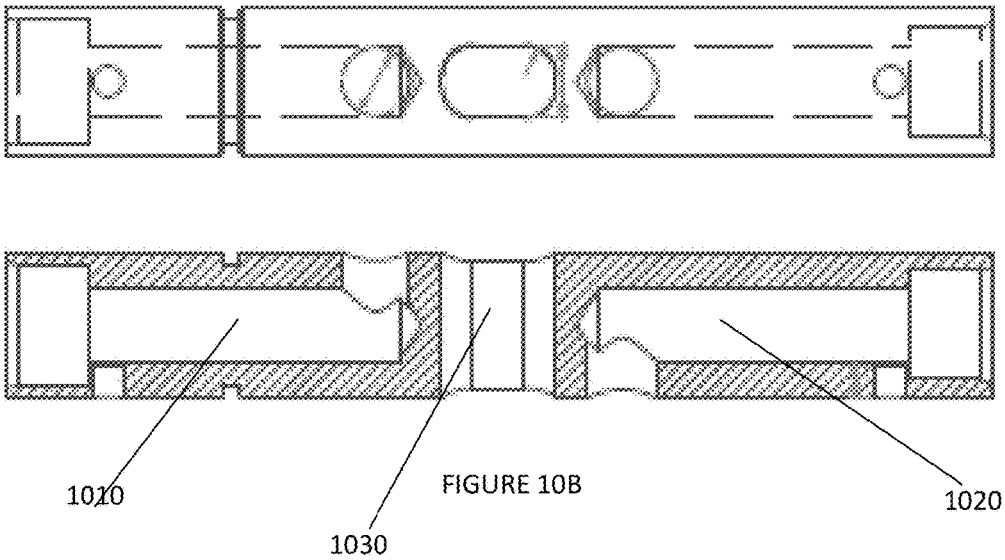

FIGS. 10A and 10B depicts a shaft 1000, according to an embodiment. As depicted in FIGS. 10A and 10B, shaft 1000 may have an inlet 1010 and outlet 1020 that are symmetrical in shape, and positioned on opposite sides of the circumference of shaft 1000. However, a water hole 1030 positioned through a diameter of shaft may be oblong and shape and have a different size than inlet 1010 and outlet 1020. More specifically, a width of water hole 1030 may be the same size as the diameter of inlet 1020 and outlet 1020, but a length of water hole may be greater than the diameter of inlet 1010 and outlet 1020.

The difference in sizing between water hole 1030 and inlet 1020 and outlet 1020 may assist water and/or smoke flow between the chambers of the water pipe due Bernoulli's principle.

Figure 11:
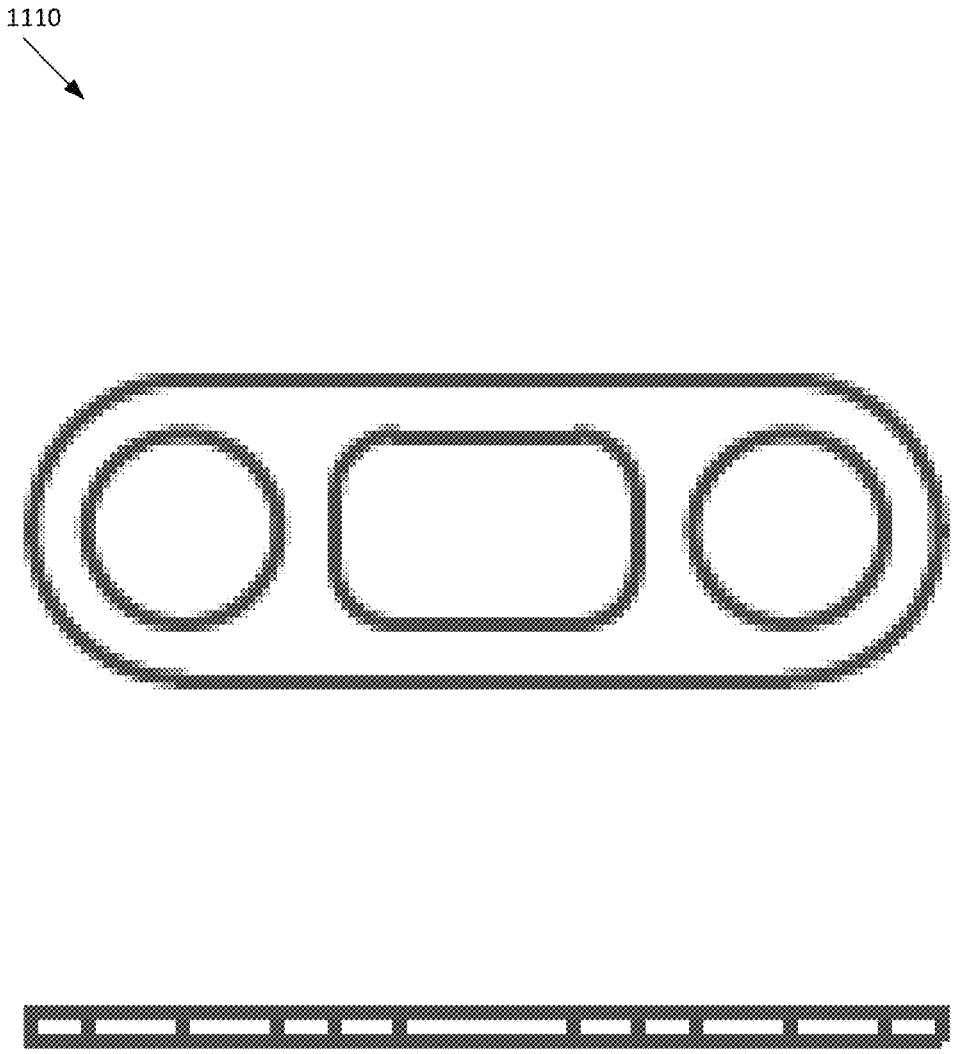
FIG. 11 depicts a seal, according to an embodiment.
Figure 12:
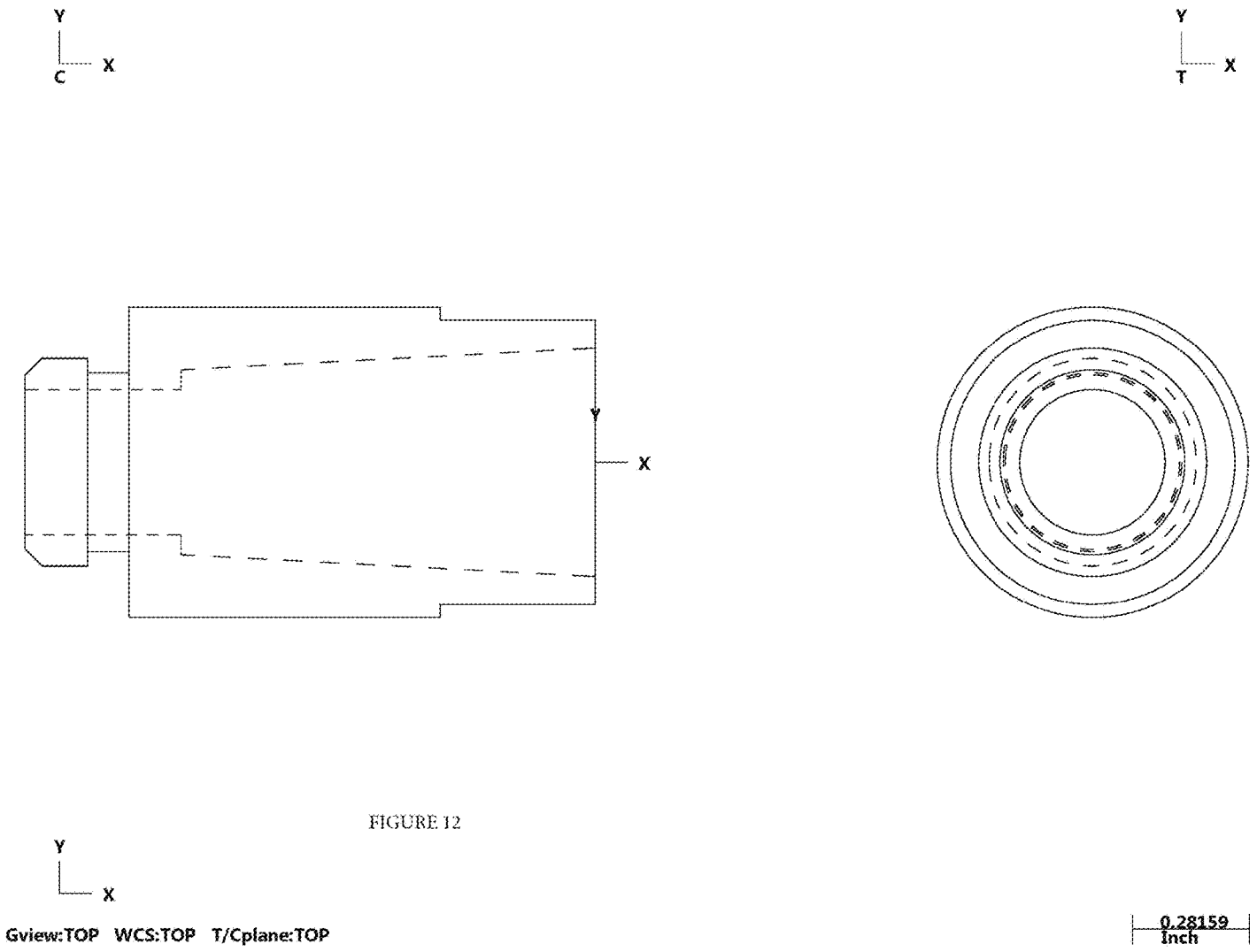
FIGS. 12-18 depicts various adapters and mouthpieces that may be coupled to the inlet or the outlet.
Figure 13:
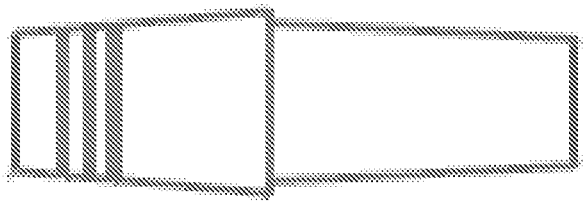
Figure 14:
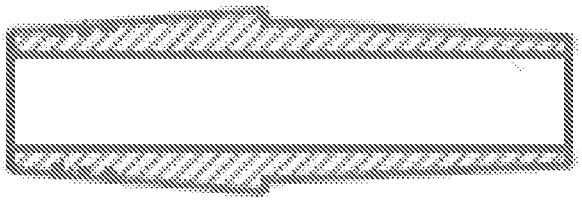
Figure 15:
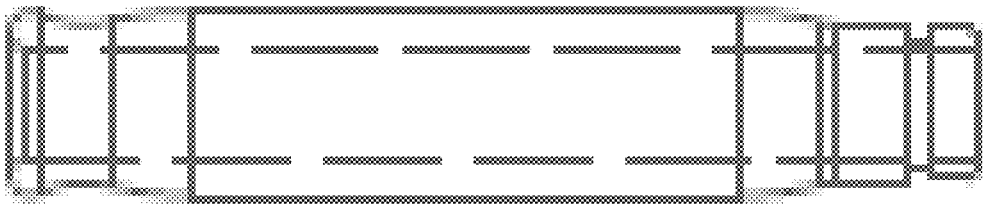
Figure 16:
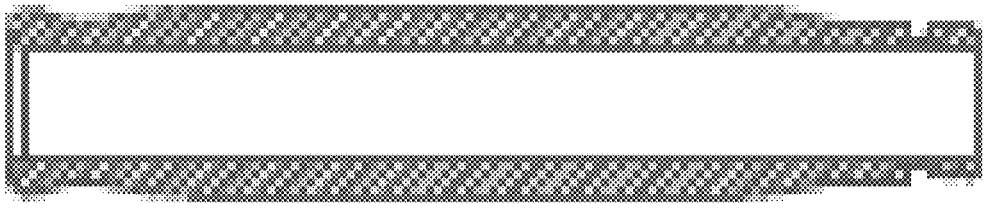
Figure 17:
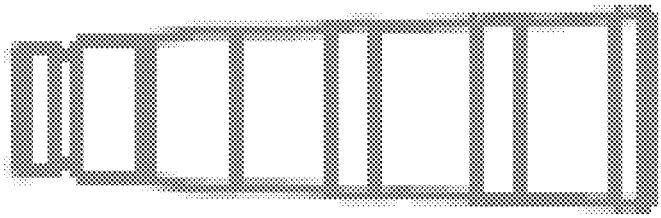
Figure 18:
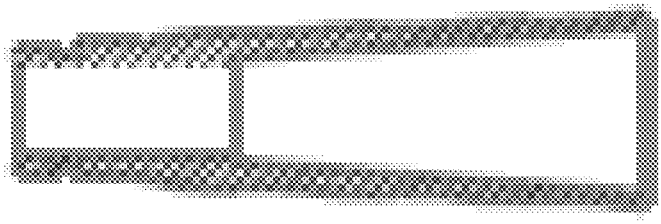

FIG. 11 depicts a seal 1100, according to an embodiment. Seal 1100 may be configured to be positioned between shaft 1100 and a coupling mechanism to form a seal between shaft 1100 and the coupling mechanism. The seal may be configured to create a closed environment, such that liquid or gas cannot exit the water pipe, when the water pipe is in the closed position, FIGS. 12-18 depicts various adapters and mouthpieces that may be coupled to the inlet or the outlet.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of code, which comprises one or more executable instructions for implementing the specified logical function(s).

What is claimed is:

1. A water pipe system comprising:

a shaft including an inlet port in communication with a first hole, central hole, and outlet port in communication with a second hole, the inlet port being positioned on a first end of the shaft, the outlet port being positioned on a second end of the shaft, the central hole being positioned perpendicular to a central axis of the shaft and extending through a diameter of the shaft between the first hole and the second hole, the first hole extending from a central axis of the shaft to a circumference of the shaft in a first direction, the second hole extending from the central axis of the shaft to the circumference of the shaft in a second direction, the first and second direction being opposite directions, the first and second hole being spaced one hundred eighty degrees from each other, wherein the shaft is configured to be fixed in place;

a first communication channel extending from the inlet port to the first hole;

a second communication channel extending from the outlet port to the second hole;

a third communication channel extending through the central hole;

a coupling interface configured to secure the shaft in place and rotate around the shaft, the coupling interface including inlet orifices, central orifices, and outlet orifices, the inlet orifices being configured to align with the first hole, the central orifices being configured to align with the central hole, and the outlet orifices being configured to align with the outlet port, wherein the inlet orifices and the outlet orifices are symmetrical;

a first chamber being coupled to a first side of the coupling interface;

a second chamber being coupled to a second side of the coupling interface, the first chamber being positioned below the second chamber in a first position and the first chamber is configured to be above the second chamber in a second position.

2. The system of claim 1, wherein when the water pipe is in an open position then a first of the inlet orifices is aligned with the first hole and a first of the outlet orifices is aligned with the outlet port.

3. The system of claim 2, wherein when the water pipe is in a closed position then the inlet orifices are misaligned with the first hole and the outlet orifices are misaligned with the outlet port.

4. The system of claim 3, wherein water is configured to be positioned in the first chamber.

5. The system of claim 4, wherein responsive to rotating the water pipe from the second position to the first position, the water positioned in the first chamber flows through the central orifices and the central hole to be positioned within the second chamber.

6. The system of claim 5, wherein the inlet port is configured to receive smoke.

7. The system of claim 6, wherein responsive to rotating the water pipe from the first position to the second position, a vacuum is be formed within the first chamber based on the displacement of water and air positioned in the second chamber flows out of the outlet port, wherein the vacuum pulls the smoke from the inlet port into the first chamber.

8. The system of claim 1, further comprising:

a first tube being coupled to a first of the inlet orifices and a second tube being coupled to a second of the inlet orifices, the first tube extending into the first chamber and the second tube extending into the second chamber.

9. The system of claim 8, wherein a first of the inlet orifices is configured to be aligned with the first hole in the first position, and a second of the inlet orifices is configured to be aligned with the first hole in the second position.

10. The system of claim 9, wherein a second of the outlet orifices is configured to be aligned with the second hole in the first position, and a first of the outlet orifices is configured to be aligned with the second hole in the second position, wherein the central orifices are aligned with the central hole in the first position and the second position.

11. A method of utilizing a water pipe comprising:

positioning a shaft through a coupling interface, the shaft including an inlet port in communication with a first hole, central hole, and outlet port in communication with a second hole, the inlet port being positioned on a first end of the shaft, the outlet port being positioned on a second end of the shaft, the central hole being positioned perpendicular to a central axis of the shaft and extending through a diameter of the shaft between the first hole and the second hole, the first hole extending from a central axis of the shaft to a circumference of the shaft in a first direction, the second hole extending from the central axis of the shaft to the circumference of the shaft in a second direction, the first and second direction being opposite directions, wherein the shaft is configured to be fixed in place, the first and second hole being spaced one hundred eighty degrees from each other, the coupling interface including inlet orifices, central orifices, and outlet orifices, the inlet orifices being configured to align with the first hole, the central orifices being configured to align with the central hole, and the outlet orifices being configured to align with the outlet port, wherein the inlet orifices and the outlet orifices are symmetrical;

forming a first communication channel extending from the inlet port to the first hole;

forming a second communication channel extending from the outlet port to the second hole;

forming a third communication channel extending through the central hole;

coupling a first chamber to a first side of the coupling interface;

coupling a second chamber to a second side of the coupling interface;

positioning the first chamber below the second chamber in a first position;

positioning the first chamber above the second chamber in a second position.

12. The method of claim 11, further comprising:

positioning the water pipe an open position by aligning a first of the inlet orifices with the first hole and aligning a first of the outlet orifices with the outlet port.

13. The method of claim 12, further comprising:

positioning the water pipe in the closed position by misaligning the inlet orifices with the first hole and misaligning the outlet orifices with the outlet port.

14. The method of claim 13, further comprising:

placing water in the first chamber before coupling the first chamber with the coupling interface.

15. The method of claim 14, further comprising:

rotating the water pipe from the second position to the first position, flowing the water positioned in the first chamber flows through the central orifices and the central hole to be positioned within the second chamber.

16. The method of claim 15, further comprising:

receiving smoke via the inlet port.

17. The method of claim 16, further comprising:

rotating the water pipe from the first position to the second position;

forming a vacuum within the first chamber based on displacement of the water, wherein the vacuum pulls the smoke from the inlet port into the first chamber;

flowing air positioned in the second chamber out of the outlet port based on the displacement of the water.

18. The method of claim 11, further comprising:

coupling a first tube to a first of the inlet orifices, the first tube extending into the first chamber;

coupling a second tube to a second of the inlet orifices, the second tube extending into the second chamber.

19. The method of claim 18, further comprising:

aligning a first of the inlet orifices with the first hole in the first position;

aligning a second of the inlet orifices with the first hole in the second position.

20. The method of claim 19, further comprising:

aligning a second of the outlet orifices with the second hole in the first position, and aligning a first of the outlet orifices with the second hole in the second position, wherein the central orifices are aligned with the central hole in the first position and the second position.

* * * * *